US009291960B2

(12) United States Patent
Yoshimura

(10) Patent No.: US 9,291,960 B2
(45) Date of Patent: Mar. 22, 2016

(54) IMAGE FORMING APPARATUS SUPPLYING OR SHUTTING OFF AC VOLTAGE TO HEAT GENERATING MEMBER

(71) Applicant: CANON KABUSHIKI KAISHA, Tokyo (JP)

(72) Inventor: Shotaro Yoshimura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/566,985

(22) Filed: Dec. 11, 2014

(65) Prior Publication Data

US 2015/0177656 A1 Jun. 25, 2015

(30) Foreign Application Priority Data

Dec. 24, 2013 (JP) ..... 2013-265540

(51) Int. Cl.
*G03G 15/20* (2006.01)
*G03G 15/00* (2006.01)

(52) U.S. Cl.
CPC ..... *G03G 15/2039* (2013.01); *G03G 15/55* (2013.01); *G03G 15/80* (2013.01)

(58) Field of Classification Search
CPC ..... G03G 15/2039; G03G 15/80
See application file for complete search history.

(56) References Cited

U.S. PATENT DOCUMENTS

2012/0230744 A1* 9/2012 Maruyama et al. ..... 399/335
2012/0301172 A1* 11/2012 Odate et al. ..... 399/88

FOREIGN PATENT DOCUMENTS

JP 2007-52176 A 3/2007

* cited by examiner

*Primary Examiner* — Sandra Brase
(74) *Attorney, Agent, or Firm* — Fitzpatrick, Cella, Harper & Scinto

(57) ABSTRACT

The image forming apparatus includes a first control unit which controls a voltage generation unit that converts an AC voltage to generate a DC voltage, a heat generation member, and a switch which supplies or shuts off electric power to the heat generation member. The first control unit acquires information for controlling the switch, and controls the switch.

24 Claims, 8 Drawing Sheets

COMMERCIAL AC VOLTAGE
Vac
0

VOLTAGE VDH1 AFTER RECTIFICATION/ SMOOTHING
Vdc3
0

VOLTAGE AT RESISTOR 134 (A/D104 INPUT VOLTAGE)
0
ZERO-CROSS POINTS

COMMERCIAL AC VOLTAGE

VOLTAGE VDH7 AFTER RECTIFICATION

HEATER CURRENT

IMAGE FORMING APPARATUS SUPPLYING OR SHUTTING OFF AC VOLTAGE TO HEAT GENERATING MEMBER

BACKGROUND OF THE INVENTION

1. Field of the Invention

The present invention relates to an image forming apparatus such as a copying machine, a facsimile and a printer which are provided with a heating apparatus, and particularly relates to a heating and fixing apparatus which heats and fixes an unfixed toner image that has been transferred onto a transfer material.

2. Description of the Related Art

A fixing apparatus in an image forming apparatus such as a copying machine, a facsimile and a printer which uses an electrophotographic process is an apparatus for heating and fixing on the transfer material an unfixed toner image, which has been transferred onto a transfer material, by a heating roller, a ceramic heater or the like. Fixing apparatuses that are generally used include a heating-roller type of fixing apparatus, in which a halogen heater is used as a heat source, and a film heating type of fixing apparatus, in which a ceramic heater is used as a heat source. In these fixing apparatuses, a heater is connected to an AC power supply through a switching control element such as a triac, and the AC power supply supplies electric power to the heater. The fixing apparatus is provided with a temperature detecting element, for instance, a thermistor temperature-sensitive element. An engine controller controls the switching control element by turning a switch ON or OFF based on information on the temperature that has been detected by this temperature detecting element. As a result, the engine controller supplies or shuts off the electric power to the heater, and controls the temperature of the fixing apparatus so that the temperature reaches a target fixed temperature (for instance, see Japanese Patent Application Laid-Open No. 2007-052176).

However, in the fixing apparatus, the power consumption of the heater is large, and accordingly, the voltage of a commercial power supply, which is in a primary side of the apparatus, is not converted into a voltage for a secondary side of the apparatus, but is directly used as-is for driving the heater. On the other hand, a control circuit for driving the heater of the fixing apparatus, for instance, such as a temperature detecting element and an engine controller which controls the heater by turning the heater on and off, based on the information on the temperature that has been detected by this temperature detecting element, functions as a circuit in the secondary side, which a user can directly touch. The control circuit in the secondary side is connected to a personal computer (PC) or network equipment. Accordingly, the distance between the heater and a heater driving circuit in the primary side, and the temperature detecting element and the control circuit in the secondary side, needs to be sufficiently secured, in order to protect the user. In addition, an expensive insulating material and an expensive insulating component need to be provided in between the element in the primary side and the element in the secondary side, and as a result, the apparatus tends to increase in price and increase in size.

In addition, as shown in Japanese Patent Application Laid-Open No. 2007-052176, when the temperature detecting element is provided in the primary side, the information on the temperature needs to be transmitted from the temperature detecting element to the engine controller and the like, which exist in the secondary side. For this reason, when the temperature detecting element is provided in the primary side, there is a possibility that the circuit configuration becomes complicated, because a PWM control which uses another component such as a comparator may be needed, for instance.

SUMMARY OF THE INVENTION

The present invention is designed under such circumstances, and enables the apparatus to be structured so as to be inexpensive and compact while securing the safety thereof.

With respect to the above described problems, the present invention provides an image forming apparatus that includes, a voltage generation unit configured to convert an input AC voltage and generates a DC voltage, a first control unit configured to control the voltage generation unit, a heat generation member configured to generate heat by supplying the AC voltage to the heat generation member, a switch for supplying or shutting off the AC voltage to the heat generation member, and a second control unit configured to control the switch. The first control unit acquires information for controlling the switch, and transmits the information to the second control unit, and the second control unit controls the switch based on the information in which the second control unit has received from the first control unit.

With respect to the above described problems, the present invention provides an image forming apparatus that includes a voltage generation unit configured to convert an input AC voltage and generates a DC voltage, a first control unit configured to control the voltage generation unit, a heat generation member configured to generate heat by supplying the AC voltage to the heat generation member, a switch for supplying or shutting off the AC voltage to the heat generation member. The first control unit acquires information for controlling the switch, and controls the switch based on the information.

Further features of the present invention will become apparent from the following description of exemplary embodiments with reference to the attached drawings.

DESCRIPTION OF THE EMBODIMENTS

Preferred Embodiments of the Present Invention will now be described in detail in accordance with the accompanying drawings.

Exemplary Embodiment 1

Image Forming Apparatus

Figure 1:
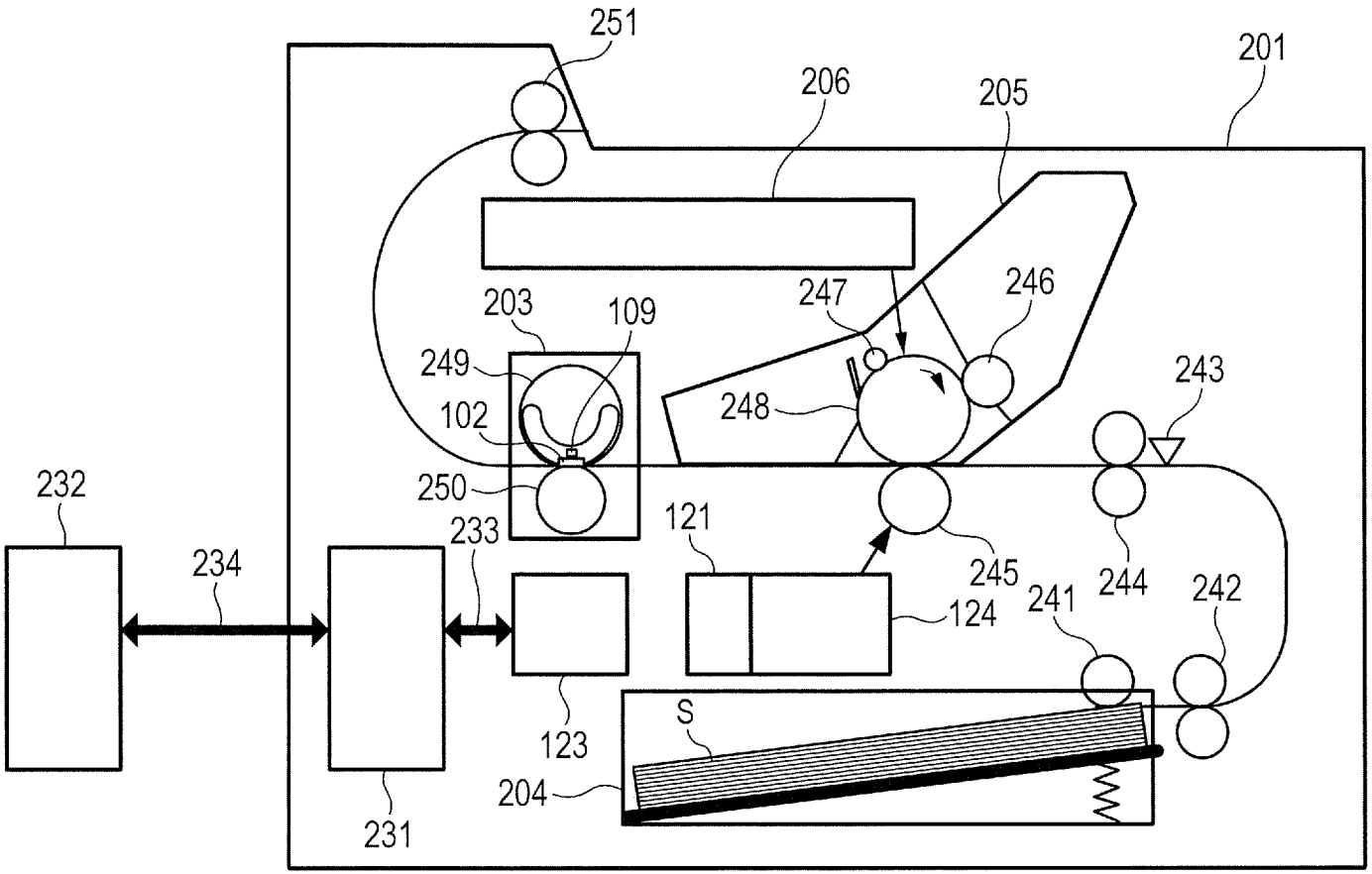
FIG. 1 is a view illustrating a configuration of an image forming apparatus of Exemplary Embodiment 1.

FIG. 1 is a sectional view illustrating a schematic structure of an image forming apparatus which uses an electrophotographic process. Incidentally, in the present exemplary embodiment, a laser beam printer will be described below as one example of the image forming apparatus, but the image forming apparatus may also be an image forming apparatus such as a copying machine, a facsimile machine, and a combined machine of the machines. An image forming apparatus 201 (hereinafter referred to as main body 201) has a sheet-feeding cassette 204 that accommodates a recording material S therein, which is a transfer material, a sheet-feeding roller 241 that pays out the recording material S from the sheet-feeding cassette 204, and a pair of conveyance rollers 242. The main body 201 has a top sensor 243, which detects the leading edge of the recording material S, and a registration roller 244 which synchronously conveys the recording material S, on the downstream side in the conveyance direction of the recording material S (hereinafter referred to simply as downstream side) of the pair of conveyance rollers 242.

The main body 201 has a cartridge unit 205, which forms a toner image on the recording material S based on a laser beam that has been emitted from a laser scanner 206, on the downstream side of the registration roller 244. The cartridge unit 205 is formed of a photosensitive drum 248 that is an image bearing member, a primary charging roller 247, a developing roller 246 and the like, which are necessary in a known electrophotographic process, and forms a toner image on the recording material S in conjunction with a transfer roller 245. The main body 201 has a fixing unit 203 for heating and fixing an unfixed toner image, which is formed on the recording material S, on the downstream side of the cartridge unit 205. The fixing unit 203 has a fixing film 249, a pressure roller 250, a heater 102 arranged in the inside of the fixing film 249, and a thermistor 109, which is arranged in the vicinity of the heater 102 and is a detecting unit for detecting the temperature of the heater 102. The heater 102 is a heat generation member, which generates heat by an electric power supplied from a commercial AC power supply 101 (see FIG. 2).

A CPU 123, which is a second control device, controls a driving unit of an unillustrated motor, clutch and the like, and thereby makes each of the rollers work, and controls the conveyance of the recording material S. The CPU 123 also controls the laser scanner 206, the cartridge unit 205, the fixing unit 203, and the like. Specifically, the CPU 123 controls an image forming operation. A video controller 231 is connected to the CPU 123 through a video interface 233, and is also connected to an external apparatus 232, such as a personal computer (hereinafter referred to as PC) through a general-purpose interface 234 (for instance, USB and the like). A power control 121 is a power supply for supplying a voltage to the CPU 123 and the like, and a drive power supply 124 which is a generation unit supplying a voltage to an unillustrated high-voltage power supply for supplying a high voltage to the driving unit and the cartridge unit 205. The main body 201 has a pair of paper ejection rollers 251 on the downstream side of the fixing unit 203, and the pair of paper ejection rollers 251 ejects the recording material S on which the toner image has been formed, and then heated and fixed.

[Configuration of Heater and Power Supply]

Figure 2:
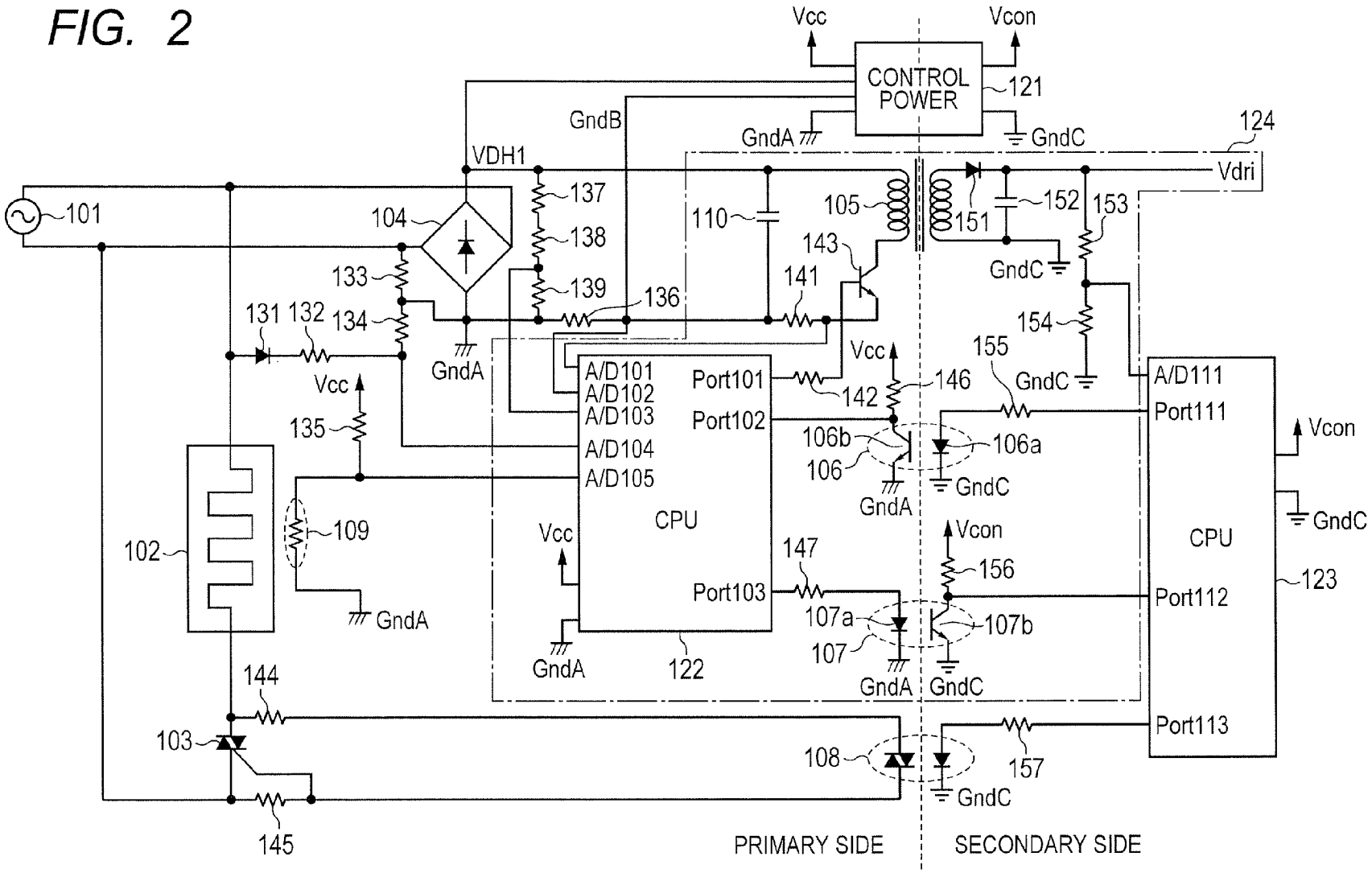
FIG. 2 is a circuit diagram illustrating a configuration of a heater, a control power and a drive power supply, in Exemplary Embodiment 1.

FIG. 2 is a circuit diagram illustrating a configuration of the heater 102, the power control 121 and the drive power supply 124 (in the figure, portion surrounded by alternate long and short dashed line), in the present exemplary embodiment. Incidentally, the dashed line in FIG. 2 is provided for showing that the left side of the dashed line is a primary side of a power transformer 105 (hereinafter referred to simply as the primary side), and the right side is a secondary side of the power transformer 105 (hereinafter referred to simply as the secondary side). The commercial AC power supply 101 is rectified by a bridge diode 104, and the voltage which has been rectified by the bridge diode 104 is input into the power control 121 and the drive power supply 124 through a resistor 136. The power control 121 is a power supply unit for supplying a voltage to a control circuit on the secondary side, and outputs a constant voltage Vcon, which is a comparatively low voltage with reference to a ground potential GndC (hereinafter referred to simply as GndC). In addition, the power control 121 functions as a power supply for supplying a voltage to the control circuit on the primary side, and outputs a constant voltage Vcc, which is a comparatively low voltage with reference to a ground potential GndA (hereinafter referred to simply as GndA). Incidentally, the GndA and a ground potential GndB (hereinafter referred to simply as GndB) are connected to each other through the resistor 136, and an electric current which flows from the GndB to the GndA can be detected as a voltage that appears between both ends of the resistor 136. All of the power supply currents that are necessary for generating a constant voltage Vcon and a constant voltage Vdri that will be described later are configured so as to flow through the resistor 136. Both of the GndA of the constant voltage Vcc, which is supplied to the control circuit on the primary side and the GndB for generating the constant voltage Vcon are connected to the primary side of the power control 121. In addition, the constant voltage Vcc is supplied also to an unillustrated control circuit which is in the inside of the power control 121.

The CPU 122, which is a first control device, is a CPU that is arranged on the primary side. The CPU 122 controls the drive power supply 124 according to directions of between TURN-ON and TURN-OFF (hereinafter referred to as on-off instructions) sent from the CPU 123. The drive power supply 124 is controlled by the CPU 122, generates the constant voltage Vdri, which is a comparatively high voltage, and outputs the generated voltage to the secondary side. Specifically, the CPU 122 makes a switching transistor (hereinafter referred to simply as transistor) 143, which is a switch element, perform an on-off operation, through a damping resistor 142, and controls the supply of the electric current to the power transformer 105. Here, as for the transistor 143, a Port 101, which is an output terminal of the CPU 122, is connected to a base terminal through the damping resistor 142, a primary winding of the power transformer 105 is connected to a collector terminal, and one end of a resistor 141 is connected to an emitter terminal.

When the transistor 143 is turned on, the voltage, which corresponds to an electric current flowing into the primary winding of the power transformer 105, is generated between both ends of the resistor 141. Therefore, the CPU 122 subtracts a voltage (voltage of GndB) to be input into an A/D 102, which is one of the analog-to-digital conversion input ports thereof (A/D input port), from a voltage to be input into an A/D 101 which is similarly an A/D input port, and determines a voltage between both of the ends of the resistor 141. Then, the CPU 122 calculates a value of a current that flows in the power transformer 105, from a known resistance value of the resistor 141. The CPU 122 controls the transistor 143 so that a voltage value of the constant voltage Vdri (that will be described later) that has been fed back from the CPU 123 becomes a predetermined voltage in such a range that the electric current flowing in the primary winding of the power transformer 105 does not exceed a predetermined current value. In addition, as will be described later, the CPU 122 also detects the temperature of the heater 102 of the fixing unit 203, detects the voltage value and the current value of the commercial AC power supply 101, and detects a zero-crossing point.

Incidentally, the drive power supply 124 shown in the present exemplary embodiment is one example, but there are various methods that can be used in a voltage generation unit, which include the power supply method, and any method may be adopted. It is also possible to provide a power factor improving circuit (PFC circuit) for improving a power factor in a preceding stage of the drive power supply 124. At this time, the CPU 122 on the primary side can further be configured so as to control the PFC circuit at the same time. In addition, in the present exemplary embodiment, the constant voltage Vcc that is generated by the power control 121 is used as a power supply necessary for the operation of the CPU 122, a control circuit on the primary side that will be described later, and the like. However, the power transformer 105 may also be configured so as to have an auxiliary winding provided therein and separately generate a constant voltage.

On the other hand, the CPU 123 is arranged on the secondary side, and operates by a constant voltage Vcon which has been output from the secondary side of the power control 121. The CPU 123 gives on-off instructions for the drive power supply 124 to the CPU 122 on the primary side, and monitors the voltage value of the constant value Vdri. Specifically, the constant voltage Vdri is divided by resistors 153 and 154, and is input into an A/D 111, which is one of the A/D input ports of the CPU 123. The CPU 123 calculates a voltage value that has been input into the A/D 111, and a voltage value of the constant voltage Vdri from a resistance ratio of the resistors 153 and 154, and gives feedback on information on the calculated voltage value of the constant voltage Vdri, to the CPU 122.

The CPU 122 on the primary side and the CPU 123 on the secondary side are connected to each other so that serial communication is enabled while insulation between the primary side and the secondary side is ensured, through a photocoupler 106, which is a second transmitting unit and a photocoupler 107, which is a first transmitting unit. In detail, as for the photocoupler 106, a Port 111 of the CPU 123 is connected to an anode side of a light-emitting diode 106*a* through a resistor 155, and the GndC is connected to a cathode side of the light-emitting diode 106*a*. The CPU 123 outputs one of a high-level signal and a low-level signal from the Port 111, which is an output terminal, and turns the light-emitting diode 106*a* of the photocoupler 106 ON (light emission) or OFF (lights-out), through the resistor 155. As for the photo transistor 106*b* of the photocoupler 106, the constant voltage Vcc is connected to the collector terminal through a pull-up resistor 146, and a Port 102, which is an input terminal of the CPU 122, is also connected to the collector terminal. In addition, as for the photo transistor 106*b* of the photocoupler 106, the GndA is connected to the emitter terminal.

When the CPU 123 outputs the high-level signal from the Port 111, the light-emitting diode 106*a* of the photocoupler 106 is turned on (light emission), the photo transistor 106*b* of the photocoupler 106 is also turned on, and the Port 102 of the CPU 122 becomes a low level. On the other hand, when the CPU 123 outputs the low-level signal from the Port 111, the light-emitting diode 106*a* of the photocoupler 106 is turned off (lights-out), the photo transistor 106*b* of the photocoupler 106 is also turned off, and the Port 102 of the CPU 122 becomes a high level. Thus, the CPU 123 can transmit data (information) to the CPU 122 through the photocoupler 106.

On the other hand, the CPU 122 outputs one of a high-level signal and a low-level signal from a Port 103, which is an output terminal, and turns a light-emitting diode 107*a* of a photocoupler 107 ON (light emission) or OFF (lights-out), through a resistor 147. Here, as for the photocoupler 107, a Port 103 of the CPU 122 is connected to an anode side of the light-emitting diode 107*a* through a resistor 147, and the GndA is connected to a cathode side of the light-emitting diode 107*a*. As for the photo transistor 107*b* of the photocoupler 107, the constant voltage Vcon is connected to the collector terminal through a pull-up resistor 156, and a Port 112, which is an input terminal of the CPU 123, is also connected to the collector terminal. In addition, as for the photo transistor 107*b* of the photocoupler 107, the GndC is connected to the emitter terminal.

When the CPU 122 outputs the high-level signal from the Port 103, the light-emitting diode 107*a* of the photocoupler 107 is turned on (light emission), the photo transistor 107*b* of the photocoupler 106 is also turned on, and the Port 112 of the CPU 123 becomes a low level. On the other hand, when the CPU 122 outputs the low-level signal from the Port 103, the light-emitting diode 107*a* of the photocoupler 107 is turned off (lights-out), the photo transistor 107*b* of the photocoupler 107 is also turned off, and the Port 112 of the CPU 123 becomes a high level. Thus, the CPU 122 can transmit data (information) to the CPU 123 through the photocoupler 106.

As has been described above, the CPU 122 and the CPU 123 enable serial communication such as UART (Universal Asynchronous Receiver Transmitter), for instance. As a result, the CPU 122 and the CPU 123 mutually transmit and receive information and data, and give control directions. Incidentally, the photocouplers 106 and 107, which are used here, have a performance and a speed necessary for a communication speed that is required for the CPU 122 and the CPU 123 to control the main body 201.

The thermistor 109 for detecting the temperature of the heater 102 is provided on the primary side. As for the thermistor 109, one side is connected to the GndA, and the other side is connected to the constant voltage Vcc through a pull-up resistor 135, and is also connected to an A/D 105 which is one of the A/D input ports of the CPU 122. In the thermistor 109, a resistance value changes according to the temperature of the heater 102. Because of this, the CPU 122 can detect the temperature of the heater 102 from the voltage value that has been input into the A/D 105. The CPU 122 transmits information on the temperature of the heater 102, which has been detected by the thermistor 109, to the Port 112 of the CPU 123 from the Port 103 through the photocoupler 107.

A bidirectional thyristor (hereinafter referred to as triac) 103, which is a switching unit, is a triac for supplying or shutting off an electric power sent from the commercial AC power supply 101, to the heater 102. The triac 103 is connected to a phototriac coupler 108 for ensuring the insulation between the primary side and the secondary side, through a resistor 144 and a resistor 145. As for the phototriac coupler 108, a Port 113 of the CPU 123 is connected to an anode side of a diode on the light emission side, through a resistor 157. In addition, as for the phototriac coupler 108, the GndC is connected to a cathode side of the diode on the light emission side. The CPU 123 outputs one of a high-level signal and a low-level signal from the Port 113, and thereby controls the light emission side of the phototriac coupler 108 by on-off control, through the resistor 157. As a result, the CPU 123 controls the triac 103 by on-off control through the phototriac coupler 108, controls the electric current flowing to the heater 102, and thereby controls the heater 102 so that the temperature reaches a predetermined target temperature. Specifically, in the present exemplary embodiment, the CPU 123 on the secondary side controls the temperature of the heater 102. Meanwhile, as for a method of controlling the electric current to the heater 102 by the CPU 123, there are, for instance, a method by phase control or wave number control, simple on-off control, and the like.

Figures 3A, 3B, 3C:
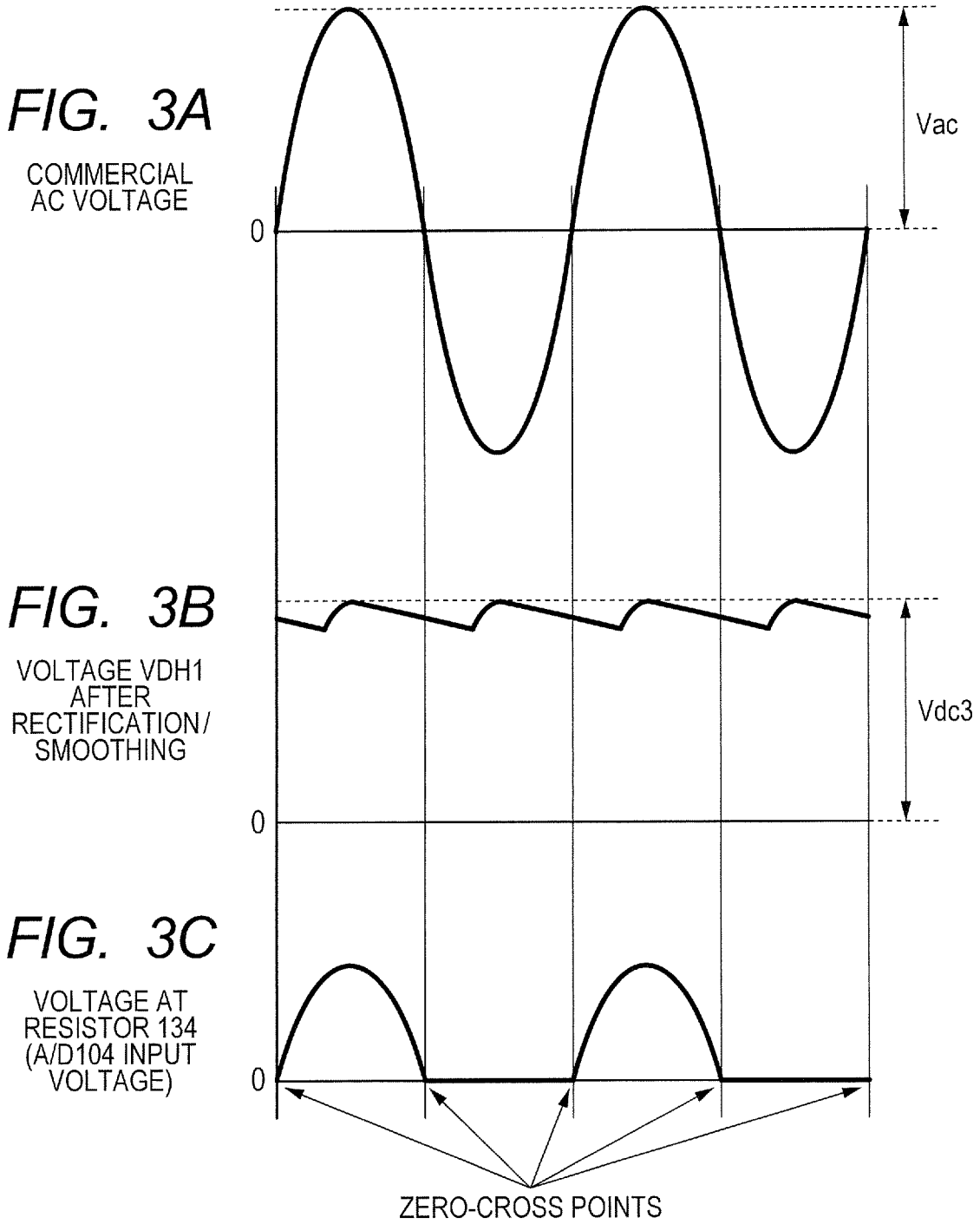
FIG. 3A is a view illustrating a control waveform of a commercial AC voltage in Exemplary Embodiment 1.
FIG. 3B is a view illustrating a control waveform of the commercial AC voltage after rectification/smoothing, in Exemplary Embodiment 1.
FIG. 3C is a view illustrating a control waveform of a resistor 134 in Exemplary Embodiment 1.

The AC voltage that has been input from the commercial AC power supply 101 is rectified by the bridge diode 104, and is applied to resistors 137, 138 and 139, which are connected in series, as a voltage VDH1 with reference to the GndA. The voltage VDH1 is a voltage that corresponds to the AC voltage that is supplied from the commercial AC power supply 101. FIG. 3A illustrates a waveform of a voltage (commercial AC voltage) of the commercial AC power supply 101, and FIG. 3B illustrates a waveform of the voltage VDH1 (voltage after rectification/smoothing) that is applied to the resistors 137, 138 and 139 that are connected in series. FIG. 3C illustrates a waveform of a voltage that is applied to a resistor 134. Here, the voltage in FIG. 3C is also a voltage that is input into an A/D 104 (A/D 104 input voltage), which is one of the A/D input ports of the CPU 122. The voltage VDH1 with reference to the GndA varies while repeating a vertical fluctuation whose the peak is a voltage Vdc3, as in the waveform in FIG. 3B. At this time, the voltage of the voltage VDH1 becomes approximately the same as the voltage value that has been smoothed by a capacitor 110, because a resistance value of the resistor 136 is comparatively small.

The voltage that is applied to the resistor 139 is input into the A/D 103 which is one of the A/D input ports of the CPU 122. The CPU 122 can calculate the voltage VDH1 from a voltage value which has been input into the A/D 103, a combined resistance of the resistors 137, 138 and 139, and a partial resistance ratio of the resistor 139, and can further detect a peak voltage Vdc3 from the voltage VDH1. Because of this, the resistors 137, 138 and 139 function as an AC voltage detecting unit. The CPU 122 transmits the detected peak voltage Vdc3 to the CPU 123 through the photocoupler 107. In addition, the CPU 122 uses the calculated voltage VDH1 also for the control of the drive power supply 124. Specifically, the CPU 122 controls the drive power supply 124 so as to suit the voltage, for instance, by changing a driving frequency and/or a duty ratio of the transistor 143 according to the voltage VDH1 to be input to the drive power supply 124, and the like.

Meanwhile, the drive power supply 124 can widen the control range for the driving frequency and the duty ratio of the transistor 143 to cope with a wide range of voltages of the commercial AC power supply 101. For instance, the CPU 122 changes settings depending on an input voltage: when the AC voltage of the commercial AC power supply 101 is 230 V, the CPU 122 increases the driving frequency of the transistor 143 to twice as large as the driving frequency of the transistor 143 when the AC voltage of the commercial AC power supply 101 is 120 V; or sets the duty ratio at ½. As a result, the drive power supply 124 can be a power supply that can cope with any of the AC voltages of 120 V and 230 V with the same configuration. In this case, the CPU 122 copes with the different voltages, by detecting the peak voltage Vdc3 before the drive power supply 124 is driven, selecting the optimal driving frequency and duty ratio, and then starting up the drive power supply 124.

The peak voltage Vdc3 includes a voltage corresponding to a voltage drop of a peak value Vac of the commercial AC voltage of the commercial AC power supply 101 (see FIG. 3A), which occurs in a path from the commercial AC power supply 101 to the resistors 137, 138 and 139. Specifically, the peak voltage Vdc3 includes the voltage reduction Vdp that occurs due to the bridge diode 104, another unillustrated filter and the like. Accordingly, a value obtained by adding these voltage reductions Vdp to the peak voltage Vdc3 becomes a peak value Vac of the commercial AC power supply 101 (Vac≈Vdc3+Vdp). Similarly, the actual effective voltage Vht (rms) to be applied to the heater 102 includes a voltage reduction Vdh that occurs due to the triac 103, an unillustrated filter, and the like, which exist in the path from the commercial AC power supply 101 to the heater 102. Accordingly, a value obtained by subtracting these voltage reductions Vdh from the effective voltage value Vac (rms) of the commercial AC power supply 101 becomes the effective voltage Vht (rms) that is actually applied to the heater 102 (Vht(rms)≈Vac (rms)−Vdh).

The CPU 123 previously stores the voltage reduction Vdp and the voltage reduction Vdh in an unillustrated storage unit, which is provided in the CPU 123, and determines the peak value Vac of the commercial AC power supply 101 by adding the Vdp to the peak voltage Vdc3 which the CPU 123 has received from the CPU 122 (Vac=Vdc3+Vdp). The CPU 123 then calculates the effective voltage value Vac (rms) of the commercial AC power supply 101 from the determined peak value Vac (Vac(rms)=Vac/√2). Furthermore, the CPU 123 calculates the effective voltage Vht (rms) to be applied to the heater 102, by subtracting the voltage reduction Vdh from the calculated effective voltage value Vac (rms) of the commercial AC power supply 101 (Vht(rms)=Vac(rms)−Vdh). Meanwhile, a method of correcting the voltage based on the voltage reduction is not limited to the above-described method. If the voltage corresponding to the voltage reduction is very small, the voltage can be neglected. In addition, the voltage may be corrected by another method.

In addition, in the present exemplary embodiment, the CPU 122 detects the peak voltage Vdc3, and after that, the CPU 123 calculates the peak value Vac, the effective voltage value Vac (rms) of the commercial AC power supply 101, and the effective voltage Vht (rms) which is applied to the heater 102. However, the CPU 122 may be configured to calculate all of the values to the effective voltage Vht (rms), and transmit the calculation result to the CPU 123 through the photocoupler 107. In addition, the CPU 122 may transmit, for instance, a value obtained by subjecting the voltage that has been detected by the A/D 103 to analog-to-digital conversion, to the CPU 123 through the photocoupler 107, in the state. The CPU 123 may also be configured so as to perform all operations from the calculation of the voltage VDH1 to the calculation of the effective voltage Vht (rms) which is actually applied to the heater 102. Specifically, the CPU 122 measures the voltage of the A/D 103 at previously determined intervals, and transmits voltage data that have been sequentially measured, to the CPU 123. The CPU 123 then calculates the voltage VDH1 from the received voltage data of the A/D 103, and detects the peak voltage Vdc3. The CPU 123 may also be configured to calculate the peak value Vac, the effective voltage value Vac (rms), and the effective voltage Vht (rms) which is applied to the heater 102. In addition, a method of calculating the effective voltage Vht (rms) that is applied to the heater 102 is not limited to the above described method, and a method other than the above described method may be used.

A diode 131 and resistors 132, 133 and 134 rectify and divide (see FIG. 3C) a voltage of the commercial AC power supply 101 (see FIG. 3A), and input the rectified and divided voltage into an A/D 104, which is one of the A/D input ports of the CPU 122. As a result, the CPU 122 detects a zero-crossing timing of the commercial AC power supply 101. Thus, the diode 131 and the resistors 132, 133 and 134 function as a zero-crossing point detecting unit. Specifically, the waveform of the voltage to be input into the A/D 104 of the CPU 122 becomes a half-wave rectified waveform as illustrated in FIG. 3C, and accordingly the CPU 122 can detect a zero-crossing point (arrowed portion in FIG. 3C) at which the commercial AC voltage changes from a positive to a negative or from the negative to the positive. The CPU 122 transmits the detected zero-crossing point to the CPU 123 on the secondary side through the photocoupler 107, and thereby the CPU 123 can suitably perform one of the phase control and the wave number control of the heater 102 according to the phase of the commercial AC power supply 101.

As has been described above, the dashed line illustrated in FIG. 2 is a boundary between the circuit on the primary side and the circuit on the secondary side, which need to be insulated from each other; and the left side of the dashed line becomes the circuit on the primary side, and the right side of the dashed line becomes the circuit on the secondary side. Insulation elements include an unillustrated power transformer and an unillustrated photocoupler in the power control 121, and the power transformer 105, the photocouplers 106 and 107, and the phototriac coupler 108 in the drive power supply 124. In the present exemplary embodiment, an insulation distance and an insulating member between the heater 102 and the thermistor 109 are unnecessary which are conventionally necessary. Incidentally, the diode 151 and the capacitor 152 rectify and smooth a voltage which has been induced by a secondary winding of the power transformer 105.

[Start-Up Processing of Power Supply]

Figure 4:
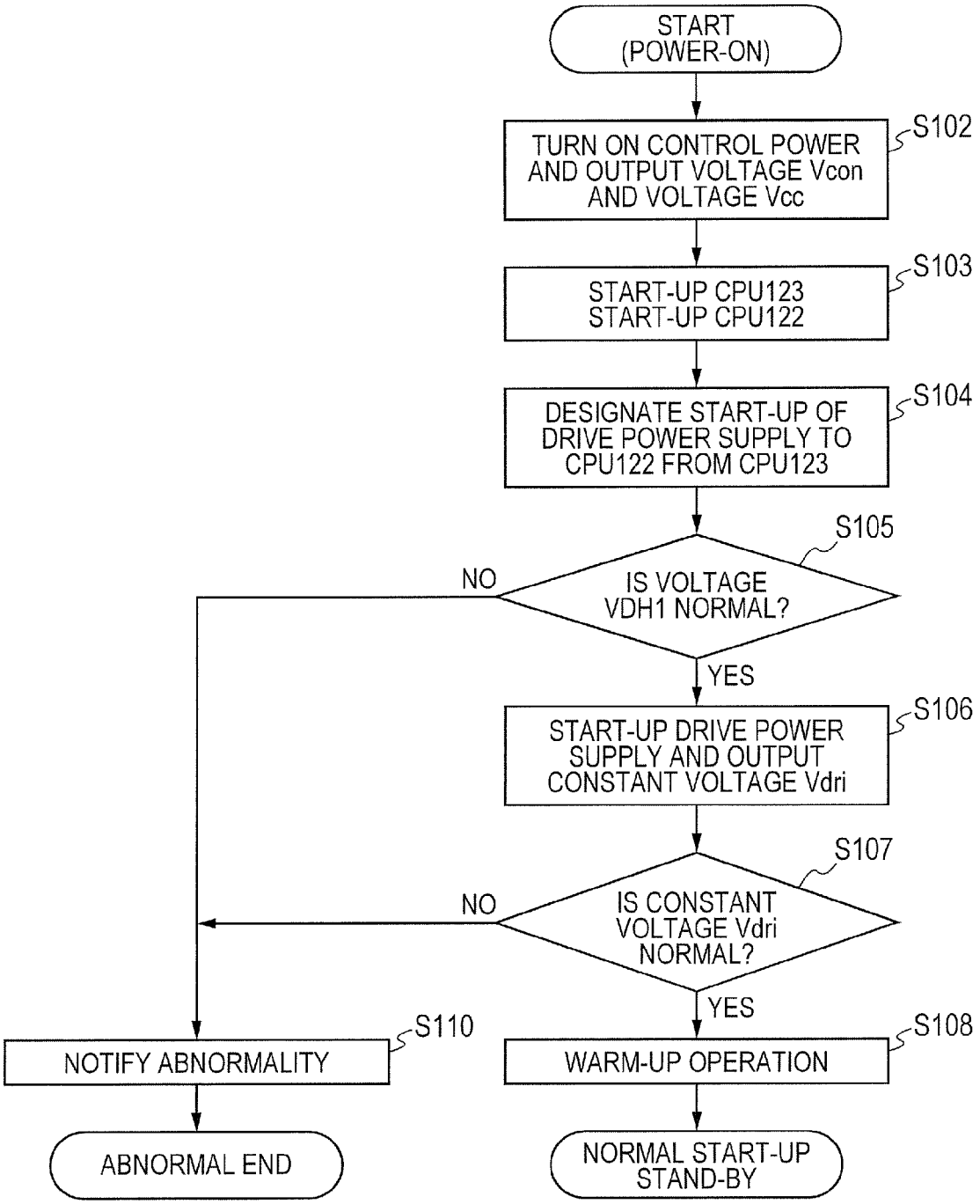
FIG. 4 is a flow chart of an image forming apparatus of Exemplary Embodiment 1.

The start-up processing of the power supply will be described below with reference to the flow chart of FIG. 4. When an unillustrated switch of the power supply of the main body 201 is turned on, the following control is started. In S102, the power control 121 is turned on by the inputting of voltage from the commercial AC power supply 101: and outputs the constant voltage Vcc from the primary side of the power control 121, and outputs the constant voltage Vcon from the secondary side of the power control 121. In S103, the constant voltage Vcon is applied from the power control 121 to the CPU 123 on the secondary side, and the CPU 123 starts up. In addition, in S103, the constant voltage Vcc is applied from the power control 121 to the CPU 122 on the primary side, and the CPU 122 also starts up.

In S104, the CPU 123 transmits a signal for starting up the drive power supply 124 (designates start-up of drive power supply) to the CPU 122 through the photocoupler 106. In S105, the CPU 122 determines whether the voltage VDH1 is at a sufficient voltage level for starting up the drive power supply 124 or not, in other words, determines whether the voltage VDH1 is normal or not. The CPU 122 calculates the voltage VDH1 based on the input value of the A/D 103 and the resistance values of the resistors 137, 138 and 139, as has been described above. Here, as for the determination which the CPU 122 performs, the CPU 122 shall determine whether the voltage VDH1 is normal or not, for instance, by storing a range of the normal values of the voltage VDH1 in an unillustrated storage unit provided in the CPU 122, and comparing the voltage VDH1 to the stored range of the normal values. When the CPU 122 has determined that the voltage VDH1 is normal, in S105, the CPU 122 starts up the drive power supply 124 in S106. In S106, the CPU 122 sets the driving frequency and the duty ratio of the transistor 143 according to the voltage VDH1, and starts the start-up of the transistor 143. The CPU 122 then appropriately changes the driving frequency and the duty ratio, while monitoring the voltage VDH1, the constant voltage Vdri which is transmitted from the CPU 123 through the photocoupler 106, and an electric current flowing in the primary winding of the power transformer 105. Thus, the CPU 122 controls the on-off operation of the transistor 143 while changing the driving frequency and the duty ratio. As a result, the drive power supply 124 outputs the constant voltage Vdri from the secondary side.

In S107, the CPU 123 determines whether the drive power supply 124 has risen and the constant voltage Vdri has reached the target voltage or not, in other words, determines whether the constant voltage Vdri is normal or not. Here, as for the determination which the CPU 123 performs, the CPU 123 shall determine whether the constant voltage Vdri is normal or not, for instance, by storing a range of the normal values of the constant voltage Vdri in an unillustrated storage unit, and comparing the constant voltage Vdri to the stored range of the normal values. When the CPU 123 has determined that the constant voltage Vdri is normal in S107, the CPU 123 performs a predetermined warm-up operation of the main body 201 in S108. In the warm-up operation, which is performed in S108, the CPU 123 starts up the heater 102 of FIG. 5, which will be described later. After the warm-up operation of S108 has ended, the main body 201 is normally started up, and shifts to a stand-by state.

When the CPU 122 has determined that the voltage VDH1 is not normal in S105, for instance, as in the case where the voltage VDH1 does not reach a predetermined voltage level, the CPU 122 notifies the CPU 123 that the voltage VDH1 is not normal through the photocoupler 107, and proceeds to the processing of S110. Meanwhile, in the processing of S105, the CPU 123 may determine the abnormality of the voltage VDH1. In addition, when the CPU 123 has determined that the constant voltage Vdri is not normal in S107, for instance, as in the case where the constant voltage Vdri does not reach a predetermined voltage level, the CPU 123 proceeds to the processing of S110. Meanwhile, the processing of S107 may be such a processing that the CPU 122, which has received information on the constant voltage Vdri from the CPU 123, determines whether the constant voltage Vdri is normal or not. In S110, the CPU 123 notifies, for example, an external apparatus 232 of the abnormality through a video controller 231, and ends a series of processings. In addition, the CPU 123 may make an unillustrated operation unit provided in the main body 201 display that the voltage VDH1 is abnormal, and may notify a user of the abnormality.

[Start-Up Processing of Heater]

Figure 5:
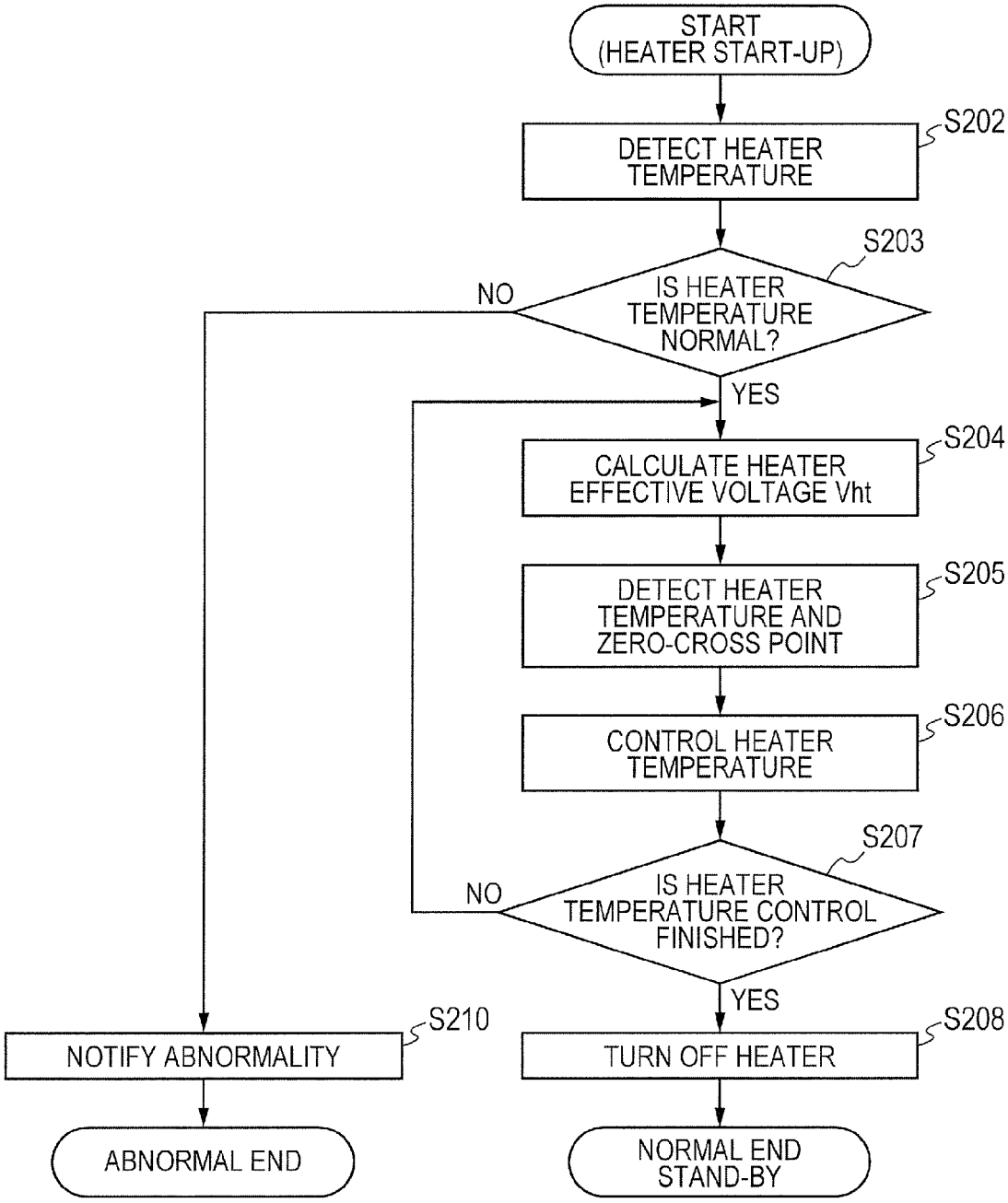
FIG. 5 is a flow chart for controlling the heater in Exemplary Embodiment 1.

Next, the start-up of the heater 102 will be described below with reference to the flow chart of FIG. 5. In the warm-up operation in S108 in FIG. 4, the CPU 123 starts the start-up processing of the heater 102 in and after S202. In S202, the CPU 122 detects the temperature of the heater 102 from the voltage of the thermistor 109 which is input into the A/D 105. The CPU 122 transmits the information on the detected temperature to the CPU 123 through the photocoupler 107. In S203, the CPU 123 determines whether the information on the temperature of the heater 102 is normal or not, which the CPU 123 has received from the CPU 122. Here, as for the determination which the CPU 123 performs, the CPU 123 shall determine whether the information on the temperature of the heater 102 is normal or not, for instance, by storing a range of the normal values of the temperature of the heater 102 in an unillustrated storage unit, and comparing the temperature of the heater 102 to the stored range of the normal values. When the CPU 123 has determined that the information on the temperature of the heater 102 is not normal in S203, the CPU 123 notifies the abnormality to the external apparatus 232 and the like through the video controller 231, and ends the start-up processing of the heater, in S210. Meanwhile, the processing of S203 may be a processing which the CPU 122 performs. In addition, the CPU 123 may also make an unillustrated operation unit provided in the main body 201 display that the voltage VDH1 is abnormal, and may notify a user of the abnormality, in S210.

When the CPU 123 has determined that the information on the temperature of the heater 102 is normal in S203, the CPU 123 calculates an effective voltage Vht (rms) to be applied to the heater 102 (heater effective voltage) in S204. Here, the CPU 123 receives the peak voltage Vdc3 of the voltage VDH1 which the CPU 122 monitors by the A/D 103, through the photocoupler 107. The CPU 123 calculates the effective voltage Vht (rms) by using the peak voltage Vdc3 which the CPU 123 has received from the CPU 122. In S205, the CPU 123 detects the temperature and the zero-crossing point of the heater 102 through the CPU 122. Here, the CPU 122 detects the zero-crossing point through the A/D 104, and transmits the zero-crossing timing to the CPU 123 through the photocoupler 107. In addition, the CPU 122 periodically transmits the information on the temperature of the thermistor 109 to the CPU 123 through the photocoupler 107. As a result, the CPU 123 detects the temperature of the heater 102 and detects the zero-crossing point.

In S206, the CPU 123 appropriately changes one of the phase angle and the duty ratio of the wave number so that a predetermined electric power is supplied to the heater 102, based on the zero-crossing timing that is transmitted from the CPU 122 and the effective voltage Vht (rms) of the heater 102, which has been calculated in S204. The CPU 123 then supplies (ON) or shuts off (OFF) the electric power to the heater 102 through the phototriac coupler 108 and the triac 103, and controls the temperature of the heater 102 so that the heater 102 reaches a predetermined temperature. The CPU 123 can accurately determine the electric power to be applied to the heater 102 from the effective voltage Vht (rms), and accordingly, can appropriately control the electric power to be supplied to the heater, according to a difference between the temperature of the heater 102 and the target temperature.

In S207, the CPU 123 determines whether the control for the temperature of the heater 102 has ended or not. In S207, when the CPU 123 has determined that the control for the temperature of the heater 102 has not ended, the CPU 123 returns to the processing of S204; and when the CPU 123 has determined that the control for the temperature has ended, the CPU 123 turns the heater 102 off in S208, ends the start-up processing of the heater 102, and shifts to a stand-by state. When the CPU 123 has received print directions from the external apparatus 232, the CPU 123 starts a print operation. The CPU 123 controls the heater 102 also during the print operation in a similar way to the time of the start-up of the heater 102, and the description thereof will be omitted.

The CPU 122 can detect voltage values which appear on both ends of the resistor 136 through the A/D 102, and can calculate a total electric current which flows in the power control 121 and the drive power supply 124 by using the resistance value of the resistor 136. The CPU 122 transmits the information on the value of the electric current which flows in the power control 121 and the drive power supply 124, to the CPU 123 through the photocoupler 107. The value of the electric current which can be supplied from the commercial AC power supply 101 is limited, and accordingly the CPU 123 calculates the value of the electric current which can be supplied to the heater 102, and can control the current value so that the current value does not exceed the specification of the commercial AC power supply 101. Specifically, the CPU 123 performs a current limiting operation by limiting the electric current which flows in the heater 102. In addition, the CPU 123 performs the current limiting operation, such as limiting the operation of the drive power supply 124 and the operation of the driving unit, which conveys the recording material S, by widening intervals between printings onto the recording materials S, decreasing the speed of an unillustrated motor and the like.

In addition, in the present exemplary embodiment, the CPU 123 uses the effective voltage Vht (rms) of the heater 102, the zero-crossing timing, the information on the temperature of the thermistor 109 and the like, for controlling the heater 102. However, the effective voltage Vht (rms) of the heater 102, the zero-crossing timing, the information on the temperature of the thermistor 109 and the like may be used while being appropriately combined with others, or may be used solely for the control of the heater 102. For instance, it is also possible to form such a circuit as to control the wave number by using a zero-crossing type of a phototriac coupler for the phototriac coupler 108, and make the CPU 123 control the heater 102 according to only the information on the temperature of the thermistor 109. In addition, it is also possible for the CPU 123 to accurately control the electric power to be supplied to the heater 102 by the phase control, based on the information on the effective voltage Vht (rms) of the heater 102 and the zero-crossing timing.

[Detection of Abnormality of CPU]

The CPU 122 and the CPU 123 always monitor mutual operating states, and when an abnormal operation is observed in one of the CPU 122 and the CPU 123 while the main body 201 is operating, the other CPU promptly performs a recovery operation from the abnormal state. When the CPU 122 has detected such abnormality that the CPU 122 cannot receive a predetermined command from the CPU 123 through the photocoupler 106 in the serial communication between the CPU 122 and the CPU 123, the CPU 122 determines that the CPU 123 is in the abnormal state, such as firmware runaway. The CPU 122 then promptly resets the CPU 123 through the photocoupler 107. In addition, the CPU 122 also determines that the CPU 123 has caused the abnormality, when the CPU 123 has not notified the abnormality of the heater 102 to the CPU 122 while the heater 102 exceeds a predetermined temperature according to the information on the temperature which is obtained from the thermistor 109 that the CPU 122 always monitors. In this case as well, the CPU 122 promptly resets the CPU 123 through the photocoupler 107.

On the other hand, when the CPU 123 cannot receive a predetermined command from the CPU 122 through the photocoupler 107 in serial communication between the CPU 123 and the CPU 122, the CPU 123 determines that the CPU 122 is abnormal. The CPU 123 then resets the CPU 122 through the photocoupler 106. In addition, the CPU 123 also determines that the CPU 122 has caused abnormality, when the CPU 122 has not notified the abnormality of the constant voltage Vdri to the CPU 123, in spite of the state in which the constant voltage Vdri that the CPU 123 always monitors does not reach a predetermined voltage or has exceeded a predetermined voltage. In this case as well, the CPU 123 promptly resets the CPU 122 through the photocoupler 106. As has been described above, even when any one of the CPU 122 and the CPU 123 has caused abnormality, the other CPU promptly detects the abnormality and promptly resets the one CPU. As a result, the recovery operation from the abnormality state can be carried out. Incidentally, in the present exemplary embodiment, the case has been described where when one CPU resets the other CPU, the one CPU resets the CPU of the other side by the command of the serial communication. However, it is also acceptable to adopt a method of newly providing a photocoupler or the like, and making one CPU directly input a signal into a reset terminal of the other CPU to reset the other CPU, as another reset signal transmitting method.

Incidentally, in the present exemplary embodiment, the case has been described where the control by the CPU has been applied to the drive power supply 124 that is used for the conveyance of the recording material S of the main body 201 and the like, but the present invention is not limited to the case. The control by the CPU can also be applied to a power supply for a control system.

As has been described above, the apparatus according to the present exemplary embodiment can be structured so as to be inexpensive and compact while securing the safety thereof.

Exemplary Embodiment 2

Configuration of Power Supply

Figure 6:
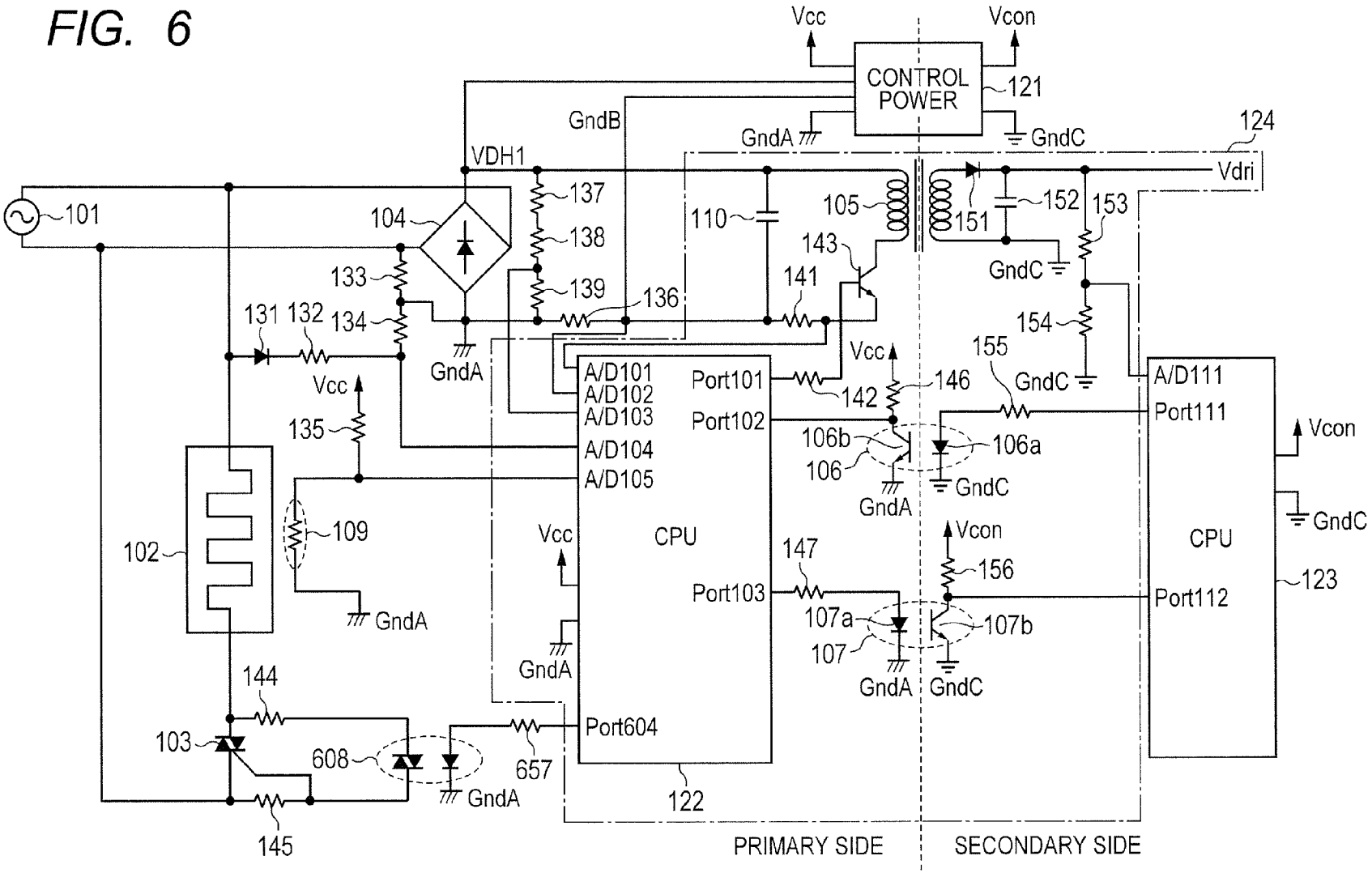
FIG. 6 is a circuit diagram illustrating a configuration of a heater, a control power and a drive power supply, in Exemplary Embodiment 2.

Exemplary embodiment 2 will be described below with reference to FIG. 6. The configuration of the image forming apparatus is similar to that of Exemplary Embodiment 1, and the description will be omitted. In addition, the same configurations as those of the circuits described in FIG. 2 are designated by the same reference numerals, and the description will be omitted. In Exemplary Embodiment 1, the CPU 122 on the primary side is configured to transmit information necessary for controlling the heater 102, such as the peak voltage Vdc3 of the commercial AC power supply 101 and the zero-crossing timing, to the CPU 123 through the photocoupler 107. In addition, the CPU 123 controls the heater 102 based on the information which the CPU 123 has received from the CPU 122. On the other hand, in the present exemplary embodiment, the CPU 122 on the primary side is configured to control the heater 102 according to the on-off instructions for the heater 102, which are output by the CPU 123 on the secondary side. Incidentally, the on-off instructions for the heater 102, which are output by the CPU 123, are for instance, directions of starting the control of the heater and directions of ending the control of the heater, and the CPU 122 controls the heater 102 according to the on-off instructions.

The triac 103 for turning on or off the supply of an electric power to the heater 102 is connected to a phototriac coupler 608 through a resistor 144 and a resistor 145. In addition, as for the phototriac coupler 608, a Port 604 of the CPU 122 on the primary side is connected to an anode side of a diode on the light emission side, through a resistor 657. In addition, as for the phototriac coupler 608, the GndA is connected to a cathode side of the diode on the light emission side. Furthermore, the CPU 122 monitors information on the temperature of the heater 102, which is input by the thermistor 109 through the A/D 105, and acquires information on the zero-crossing timing of the commercial AC power supply 101 from the waveform of the voltage which is input into the A/D 104.

In addition, the CPU 122 calculates the effective voltage Vht (rms) of the commercial AC power supply 101 which is applied to the heater 102, from the peak voltage Vdc3 of the voltage VDH1 which is input into the A/D 103. The CPU 122 appropriately changes one of the phase angle and the duty ratio of the wave number so that a predetermined electric power is charged to the heater 102, based on the information on the temperature of the heater 102, the zero-crossing point and the effective voltage Vht (rms). The CPU 122 then supplies (ON) or shuts off (OFF) the electric power to the heater 102 through the phototriac coupler 608 and the triac 103, and controls the temperature of the heater 102 so that the heater 102 reaches a predetermined temperature.

Thus, the difference between Exemplary Embodiment 2 and Exemplary Embodiment 1 is that the phototriac coupler 608 becomes an element on the primary side in the present exemplary embodiment. Because of this, it is not necessary to use an insulation element such as the phototriac coupler 608 for controlling the triac 103. The configuration is not limited to the present exemplary embodiment. Others are similar to those in Exemplary Embodiment 1 (FIG. 2), and the description will be omitted. Incidentally, in the present exemplary embodiment, the CPU 123 arranged on the secondary side gives the on-off instructions for the heater 102 to the CPU 122, but the control method is not limited to the above described control method. For instance, the CPU 122 on the primary side may be configured to perform all the controls.

As has been described above, the apparatus according to the present exemplary embodiment can be structured so as to be inexpensive and compact while securing the safety thereof.

Exemplary Embodiment 3

Configuration of Power Supply

Figure 7:
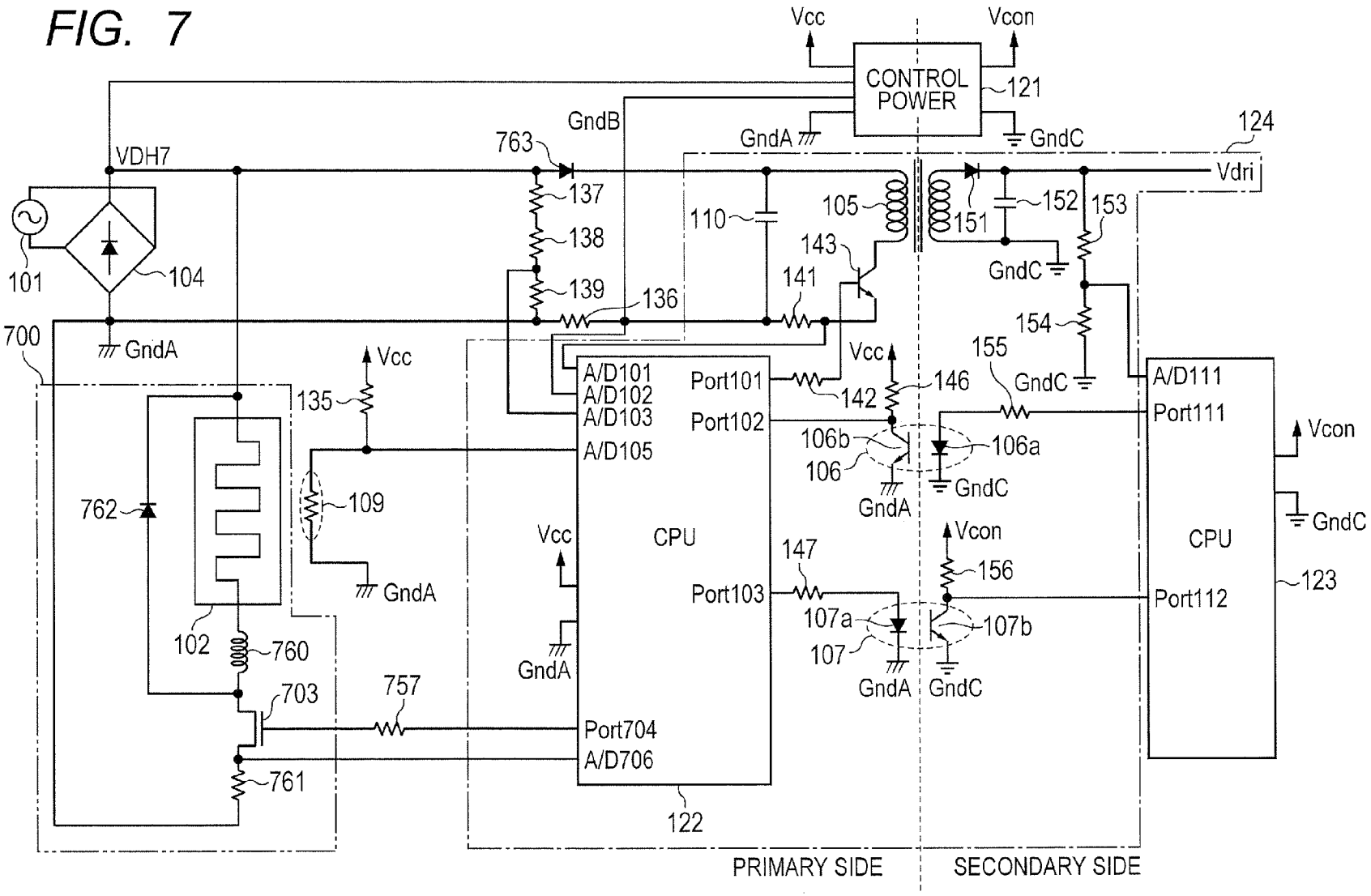
FIG. 7 is a circuit diagram illustrating a configuration of a heater, a control power and a drive power supply, in Exemplary Embodiment 3.

Exemplary Embodiment 3 will be described below with reference to FIG. 7. The configuration of the image forming apparatus is similar to that of Exemplary Embodiment 1, and the description will be omitted. In addition, the same configurations as those of the circuits described in FIG. 2 and FIG. 6 are designated by the same reference numerals, and the description will be omitted. In Exemplary Embodiments 1 and 2, the heater 102 of the fixing unit 203 is positioned on the input side (preceding stage) of the bridge diode 104, and an AC voltage has been supplied to the heater. In the present exemplary embodiment, the heater 102 is configured to be positioned on the output side (subsequent stage) of the bridge diode 104, and be controlled by the switching of DC voltage.

A field-effect transistor (hereafter referred to as FET) 703, which is a switching unit, is an FET for turning on or off the supply of an electric power from the commercial AC power supply 101 to the heater 102, and the gate terminal of the FET 703 is connected to a Port 704 of the CPU 122 through a resistor 757. A resistor 761 is a resistor for monitoring an electric current to be supplied to the heater 102, and the CPU 122 detects the electric current to be supplied to the heater 102 according to the voltage to be input into an A/D 706 which is one of the A/D input ports. A coil 760 and a diode 762 are elements for smoothing the electric current which flows in the heater 102 when the FET 703 performs the switching operation. A portion surrounded by a chain double-dashed line shall be a heater driving circuit 700.

Figures 8A, 8B, 8C:
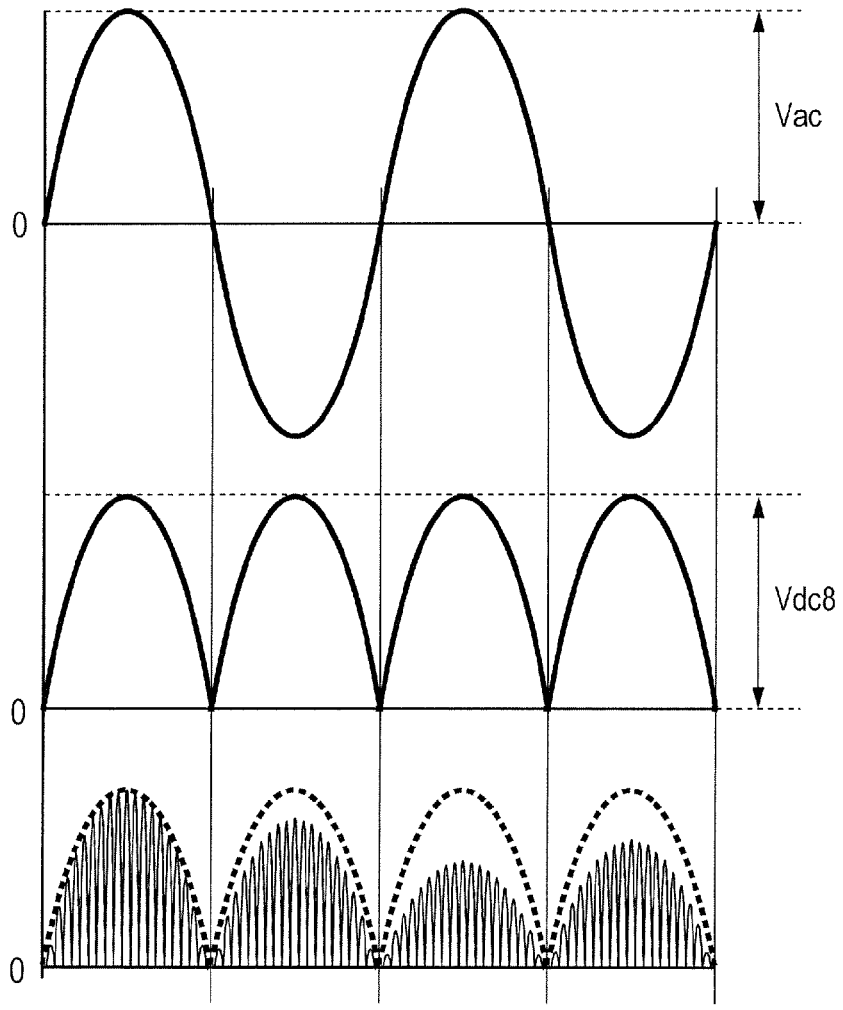
FIG. 8A is a view illustrating a control waveform of a commercial AC voltage in Exemplary Embodiment 3.
FIG. 8B is a view illustrating a control waveform of the commercial AC voltage after rectification/smoothing, in Exemplary Embodiment 3.
FIG. 8C is a view illustrating a control waveform of a heater current, in Exemplary Embodiment 3.

FIG. 8A is a view illustrating a waveform of the voltage of the commercial AC power supply 101. FIG. 8B is a view illustrating a waveform of a voltage VDH7 which is output from the bridge diode 104. FIG. 8C is a view illustrating a waveform of an electric current which flows in the heater 102. Here, in FIG. 8C, the maximum current value in a range of values of the electric current that can be passed to the heater 102 is illustrated by a dashed line. In addition, the amplitude of the waveform of the electric current which flows in the heater 102 becomes large, when an on-width of the FET 703 (time period during which FET 703 is turned on) is large, and the amplitude becomes small, when the on-width of the FET 703 is small. Thus, the CPU 122 controls the electric current that flows in the heater 102, by controlling the on-width of the FET 703.

The voltage of the commercial AC power supply 101 forms a sinusoidal waveform in which the peak value Vac is the peak as in FIG. 8A, and is rectified by the bridge diode 104. The voltage which has been rectified by the bridge diode 104 (voltage after rectification) is applied to a heater driving circuit 700 and resistors 137, 138 and 139 that are connected in series, as a voltage VDH7 with reference to the GndA. At this time, as for the voltage VDH7, the electric current that flows from the capacitor 110 to the heater 102 side is shut off by a diode 763, and accordingly the waveform of the voltage VDH7 becomes a full-wave rectified waveform in which the Vdc8 is the peak as in FIG. 8B. The voltage VDH7 is a voltage corresponding to the AC voltage that is supplied from the commercial AC power supply 101. Because of this, the resistors 137, 138 and 139 function as the AC voltage detecting unit. The CPU 122 detects the effective voltage VDH7 (rms) of the voltage VDH7 from the peak voltage Vdc8 of the voltage VDH7. The FET 703 controls an electric power to be supplied to the heater 102 by performing a PMW control at a predetermined frequency. Therefore, in the present exemplary embodiment, it becomes unnecessary for the CPU 122 to detect the zero-crossing timing of the commercial AC power supply 101.

In the present exemplary embodiment, the resistor 761 has a comparatively small value, and accordingly a voltage to be supplied to the heater 102, the coil 760 and the FET 703 in the subsequent stage is almost the same value as the effective voltage VDH7 (rms). Therefore, in the present exemplary embodiment, the CPU 122 does not correct an input voltage. However, the CPU 122 may be configured so as to appropriately correct the voltage, as needed, depending on the adopted configuration.

The configuration of the heater driving circuit 700 in the present exemplary embodiment can cope with a wide range of voltages of the commercial AC power supply 101, by an operation of widening the control range for the driving frequency and duty ratio for driving the FET 703 which drives the heater 102. For instance, when the AC voltage of the commercial AC power supply 101 is 230 V, the heater driving circuit 700 increases the driving frequency to twice as large as the driving frequency when the AC voltage of the commercial AC power supply 101 is 120 V, or sets the duty ratio at ½. Thus, the heater driving circuit 700 is configured to change settings so as to suit to the effective voltage VDH7 (rms). As a result, the heater driving circuit 700 can constitute a fixing unit 203 that can cope with any of the AC voltages of 120 V and 230 V by the same configuration as that in the present exemplary embodiment. In this case, the CPU 122 copes with the different voltages, by detecting the effective voltage VDH7 (rms) before the heater 102 is driven, selecting the optimal driving frequency and duty ratio, and then driving the heater 102.

In addition, the CPU 122 can detect a value of an electric current to be supplied to the heater 102, by the resistor 761. Specifically, the CPU 122 can calculate the value of the electric current which flows in the heater 102, from the voltage which is input to the A/D 706, by using the resistance value of the resistor 761, and thereby the CPU 122 can accurately control the electric power to be supplied to the heater 102. Furthermore, the CPU 122 can perform the optimal operation of the apparatus, based on the electric current of the heater 102 which is calculated based on the voltage that is input into the A/D 706, and the total of the electric currents which flow in the power control 21 and the drive power supply 124 that are detected by the A/D 102. Specifically, the value of the electric current which can be supplied from the commercial AC power supply 101 is restricted, and accordingly the CPU 122 transmits the information on the electric current which flows in the heater 102 and the electric current which flows in the power supply, to the CPU 123 through the photocoupler 107. The CPU 123 then limits the electric current which flows in the heater 102. In addition, the CPU 123 limits the operation of the drive power supply 124 and the operation of the driving unit which conveys the recording material S, by widening intervals between printings onto the recording materials S, decreasing the speed of an unillustrated motor and the like. Thus, the CPU 123 performs a current limiting operation, and prevents the electric current passed from the commercial AC power supply 101 from exceeding a specified current value. In this case, the power supply current and the fixed electric current are limited by the CPU 122 and the CPU 123 which appropriately cooperate.

An electric power of the commercial AC power supply 101 is rectified by the bridge diode 104; and the rectified electric power is output through the diode 763 for preventing a backflow of an electric current to the heater 102 side, and a resistor 136 for detecting the power supply current, and is supplied to the power control 121 and the drive power supply 124. The subsequent operations of the periphery of the power control 121 and the drive power supply 124 are as described in Exemplary Embodiment 1 and Exemplary Embodiment 2. In addition, an insulation element used in the present exemplary embodiment is similar to that in Exemplary Embodiment 2 (FIG. 6). Incidentally, in the present exemplary embodiment, the CPU 122 controls the FET 703 by on-off, but the CPU 123 may be configured so as to control the FET 703 by on-off through the insulation element.

As has been described above, the apparatus according to the present exemplary embodiment can be structured so as to be inexpensive and compact while securing the safety thereof.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-265540, filed Dec. 24, 2013, which is hereby incorporated by reference herein in its entirety.

What is claimed is:

1. An image forming apparatus comprising:

a voltage generation unit configured to convert an input AC voltage to generate a DC voltage;

a first control unit configured to control the voltage generation unit;

a heat generation member configured to generate heat by being supplied with the AC voltage;

a switch configured to supply or shut off the AC voltage to the heat generation member; and a second control unit configured to control the switch, wherein the first control unit acquires information for controlling the switch, and transmits the information to the second control unit, and wherein the second control unit controls the switch based on the information the second control unit has received from the first control unit.

2. An image forming apparatus according to claim 1,
wherein the second control unit transmits information regarding the DC voltage generated by the voltage generation unit to the first control unit, and
wherein the first control unit controls the voltage generation unit based on the information regarding the DC voltage that is received by the first control unit from the second control unit.

3. An image forming apparatus according to claim 1, further comprising:
a first transmitting unit configured to transmit the information from the first control unit to the second control unit; and
a second transmitting unit configured to transmit information from the second control unit to the first control unit.

4. An image forming apparatus according to claim 3, wherein the first control unit resets the second control unit through the first transmitting unit, in a case where the second control unit is determined to be abnormal.

5. An image forming apparatus according to claim 3, wherein the second control unit resets the first control unit through the second transmitting unit, in a case where the first control unit is determined to be abnormal.

6. An image forming apparatus according to claim 1, further comprising:
an image forming unit configured to form an unfixed toner image on a recording material;
a fixing unit having the heat generation member, wherein the fixing unit fixes the unfixed toner image formed by the image forming unit onto the recording material; and
a conveyance unit configured to convey the recording material,
wherein the second control unit controls the image forming unit, the fixing unit and the conveyance unit.

7. An image forming apparatus according to claim 1, further comprising a detection unit configured to detect the temperature of the heat generation member,
wherein the information for controlling the switch includes information regarding the temperature of the heat generation member detected by the detection unit.

8. An image forming apparatus according to claim 1, further comprising a zero-crossing point detection unit configured to detect a zero-crossing point of the AC voltage,
wherein the information for controlling the switch includes information regarding the zero-crossing point detected by the zero-crossing point detection unit.

9. An image forming apparatus according to claim 1, further comprising an AC voltage detection unit configured to detect the AC voltage or a voltage corresponding to the AC voltage,
wherein the information for controlling the switch includes information regarding the AC voltage and the voltage corresponding to the AC voltage detected by the AC voltage detection unit.

10. An image forming apparatus according to claim 1, wherein the voltage generation unit has a transformer configured to insulate a primary side and a secondary side from each other, and a switch element configured to turn on and off an electric current flowing to a circuit on the primary side of the transformer, and
wherein the first control unit controls the switch element.

11. An image forming apparatus according to claim 10, wherein the first control unit is provided in the circuit on the primary side.

12. An image forming apparatus according to claim 10, wherein the second control unit is provided in the circuit on the secondary side.

13. An image forming apparatus comprising:
a voltage generation unit configured to convert an input AC voltage to generate a DC voltage;
a first control unit configured to control the voltage generation unit;
a heat generation member configured to generate heat by being supplied with the AC voltage;
a switch configured to supply or shut off the AC voltage to the heat generation member; and
a second control unit configured to output a signal to designate control of the switch, to the first control unit,
wherein the first control unit acquires information for controlling the switch, and controls the switch based on the information.

14. An image forming apparatus according to claim 13,
wherein the second control unit transmits information regarding the DC voltage generated by the voltage generation unit to the first control unit, and
wherein the first control unit controls the voltage generation unit based on the information regarding the DC voltage received by the first control unit from the second control unit.

15. An image forming apparatus according to claim 13, further comprising:
a first transmitting unit configured to transmit information from the first control unit to the second control unit; and
a second transmitting unit configured to transmit information from the second control unit to the first control unit.

16. An image forming apparatus according to claim 15, wherein the first control unit resets the second control unit through the first transmitting unit, in a case where the second control unit is determined to be abnormal.

17. An image forming apparatus according to claim 15, wherein the second control unit resets the first control unit through the second transmitting unit, in a case where the first control unit is determined to be abnormal.

18. An image forming apparatus according to claim 13, further comprising:
an image forming unit configured to form an unfixed toner image on a recording material;
a fixing unit having the heat generation member, wherein the fixing unit fixes the unfixed toner image formed by the image forming unit onto the recording material; and
a conveyance unit configured to convey the recording material,
wherein the second control unit controls the image forming unit, the fixing unit and the conveyance unit.

19. An image forming apparatus according to claim 13, further comprising a detection unit configured to detect the temperature of the heat generation member,
wherein the information for controlling the switch includes information regarding the temperature of the heat generation member detected by the detection unit.

20. An image forming apparatus according to claim 13, further comprising a zero-crossing point detection unit configured to detect a zero-crossing point of the AC voltage,
wherein the information for controlling the switch includes information regarding the zero-crossing point detected by the zero-crossing point detection unit.

21. An image forming apparatus according to claim 13, further comprising an AC voltage detection unit configured to detect the AC voltage or a voltage corresponding to the AC voltage,
wherein the information for controlling the switch includes information regarding the AC voltage and the voltage corresponding to the AC voltage detected by the AC voltage detection unit.

22. An image forming apparatus according to claim 13, wherein the voltage generation unit has a transformer configured to insulate a primary side and a secondary side from each other, and a switch element configured to turn on and off an electric current flowing to a circuit on the primary side of the transformer, and wherein the first control unit controls the switch element.

23. An image forming apparatus according to claim 22, wherein the first control unit is provided in the circuit on the primary side.

24. An image forming apparatus according to claim 22, wherein the second control unit is provided in the circuit on the secondary side.

* * * * *